United States Patent [19]

Mazzarella et al.

[11] 4,214,948

[45] Jul. 29, 1980

[54] METHOD OF SIZING PAPER

[75] Inventors: Emil D. Mazzarella, Mountainside; Leonard J. Wood, Jr., Berkeley Heights; Walter Maliczyszyn, Piscataway, all of N.J.

[73] Assignee: National Starch and Chemical Corporation, Bridgewater, N.J.

[21] Appl. No.: 656,408

[22] Filed: Feb. 9, 1976

Related U.S. Application Data

[63] Continuation-in-part of Ser. No. 535,442, Dec. 23, 1974, abandoned, which is a continuation-in-part of Ser. No. 493,311, Jul. 31, 1974, abandoned.

[51] Int. Cl.[2] ..... D21H 3/08

[52] U.S. Cl. ..... 162/158

[58] Field of Search ..... 162/158, 166, 168; 106/213, 238, 287.2; 260/343.9

[56] References Cited

U.S. PATENT DOCUMENTS

| | | | |
|---|---|---|---|
| 2,785,067 | 3/1957 | Osberg | 162/158 |
| 2,856,310 | 10/1958 | Weisgerber | 162/158 |
| 3,499,824 | 3/1970 | Strazdins et al. | 162/166 |

FOREIGN PATENT DOCUMENTS

| | | | |
|---|---|---|---|
| 804504 | 11/1958 | United Kingdom | 162/158 |

OTHER PUBLICATIONS

Casey, "Pulp & Paper", vol. II, (1960), p. 633.

*Primary Examiner*—S. Leon Bashore
*Assistant Examiner*—Peter Chin
*Attorney, Agent, or Firm*—James & Franklin

[57] ABSTRACT

A size mixture comprising a higher organic ketene dimer and polyoxyalkylene alkyl or alkyl-aryl ether or the corresponding mono- or di-ester is used to size paper products. In accordance with a preferred embodiment the liquid size mixture is added directly to the paper stock system without prior emulsification.

2 Claims, No Drawings

METHOD OF SIZING PAPER

This application is a continuation-in-part of our copending U.S. application, Ser. No. 534,442 filed Dec. 23, 1974 which application is a continuation-in-part of U.S. application Ser. No. 493,311 filed July 31, 1974, both now abandoned.

BACKGROUND OF THE INVENTION

I. Field of the Invention

This invention relates to an improved method for the sizing of paper products and to the sizing compositions used therein. More particularly, the invention relates to an improved method for sizing paper and paperboard products under specified conditions using a mixture comprising higher organic ketene dimers and specific polyoxyalkylene alkyl or alkyl-aryl ethers or the corresponding mono- or di-esters. The invention also has as a preferred embodiment a method for sizing paper products directly in the paperstock preparation system without the need for prior emulsification of the size agent.

As used herein, the term "paper and paperboard" includes sheet-like masses and molded products made from fibrous cellulosic materials which may be derived from both natural and synthetic sources. Also included are sheet-like masses and molded products prepared from combinations of cellulosic and non-cellulosic materials derived from synthetics such as polyamide, polyester and polyacarylic resin fibers as well as from mineral fibers such as asbestos and glass.

II. Brief Description of the Prior Art

It is recognized that paper and paperboard are often sized with various hydrophobic materials including, for example, rosin, wax emulsions, mixtures of rosin with waxes, isocyanate derivatives, fatty acid complexes, fluorocarbons, certain styrenemaleic anhydride copolymers, substituted cyclic dicarboxylic acid anhydrides, as well as selected ketene dimers more particularly described hereinafter. These materials are referred to as sizes or sizing and they may be introduced during the actual paper making operation wherein the process is known as internal or engine sizing. On the other hand, they may be applied to the surface of the finished web or sheet in which case the process is known as external or surface sizing.

In order to obtain good sizing with any of the previously described sizing compounds, it is desirable that they be uniformly dispersed throughout the fiber slurry in as small a particle size as is possible to obtain. In accordance with the known methods of adding these sizing compounds to the paper stock prior to web formation, therefore, the sizing compound is added in the form of an aqueous emulsion prepared with the aid of emulsifying agents including, for example, cationic or ordinary starches, carboxymethyl cellulose, natural gums, gelatin, cationic polymers or polyvinyl alcohol, all of which act as protective colloids.

These prior art techniques which utilized emulsifying agents with or without added surfactants did, however, suffer from several inherent deficiencies in commercial practice. A primary deficiency concerned the necessity of utilizing relatively complex, expensive and heavy equipment capable of exerting high homogenizing pressures, together with rigid procedures regarding emulsifying proportions and temperatures, etc., for producing a satisfactory stable emulsion of the particular size. Additionally, the use of many surfactants was found to create operational problems in the papermaking process such as severe foaming of the stock and/or loss in sizing. Moreover, even after satisfactory emulsions were formed, many of the compositions detrimentally affected the other properties of the sized paper resulting, for example, in loss of wet strength. Another drawback noted with various size emulsions prepared with certain surfactants was that on aging of the treated paper, many small hydrophilic spots were formed as evidenced by an ink dip test. With particular reference to the procedures of the prior art which utilized ketene dimers as sizing agents, it has been necessary in commercial practice to pre-emulsify with cationic starch, surfactants and/or emulsifiers such as sodium lignosulfonate, polyoxyethylene sorbitan trioleate, polyoxyethylene sorbitol hexaoleate or polyoxyethylene sorbitol oleatelaurate and/or hydrocolloids using relatively rigid procedures with elevated temperatures and high shearing and/or high pressure homogenizing equipment. Alternatively, the ketene dimers have been adsorbed on silica gel and added directly to the beaters or hydropulpers. Unless these complicated procedures are carefully followed, the methods result in process difficulties such as deposition in the paper system, quality control problems and generally unsatisfactory performance.

There is thus a need in the art for a method for sizing paper and paperboard products which will eliminate the homogenizing equipment now required for producing an emulsion and will result in more flexibility in preparing and handling the size mixture. There is also a need for a method for producing emulsions of smaller particle size and superior stability to those prepared by the methods of the prior art, the use of which will result in improved sizing performance and improved operability.

SUMMARY OF THE INVENTION

In accordance with the method of the present invention, a size mixture is prepared by combining 80–97 parts, preferably 90–95 parts, by weight, of at least one higher organic ketene dimer and 3–20 parts, preferably 5–10 parts, by weight, of a polyoxyalkylene alkyl or polyoxyalkylene alkyl-aryl ether or the corresponding mono- or di-ester. These size mixtures are easily emulsifiable with water in the absence of high shearing forces and under normal pressure by merely stirring, passing through a mixing valve or common aspirator or by the usual agitation present in a stock preparation system. By stating that these components are emulsified in the absence of high shearing forces is meant that the use of high shearing forces such as are present in Waring blenders or other high speed agitators etc. are not required; the use of normal pressures means that such pressures as are found in homogenization equipment are also not required. At least one of the latter techniques was required in forming emulsions in accordance with prior art teachings. With respect to further clarifying the meaning of "agitation" necessary for emulsification herein, it is explained that emulsification will take place with any kind of mixing action. While high speed agitation and/or shearing action and homogenization may be used to produce the sizing emulsions, they are not required. The emulsion thus produced in accordance with the process of our invention is adequately stable for commercial purposes and possesses a sufficiently small particle size to produce excellent sizing of the resultant web.

In carrying out the present invention the emulsion, formed in the absence of high shearing forces and under normal pressures, is intimately dispersed within the paper stock system prior to its passing through the drying stage of the paper making operation in an amount sufficient to provide a concentration of the ketene dimer of from 0.01 to 2.0%, based on dry fiber weight. In accordance with the embodiments of the invention, the sizing emulsion may be formed prior to introduction into the paper stock system or the emulsion may be formed in situ within the paper stock system in the presence of good agitation at any point during preparation thereof.

It is a feature of this invention that in accordance with a preferred embodiment, certain of the size mixtures disclosed herein may be used in the sizing method without any prior emulsification step. In accordance with this variation, the components are premixed without water and added to the paper stock preparation system at any point during preparation where good agitation can be achieved. It has been found that the required degree of "good agitation" is achieved when passing through refiners, pumps and other operating equipment, thereby producing the emulsion in situ and excellent sizing properties in the resultant sized web.

It is another feature of the compositions and method of the present invention that the resultant sized paper product is characterized by reduced water and ink absorption as well as by increased resistance to aqueous acid and alkaline solutions.

DESCRIPTION OF THE PREFERRED EMBODIMENTS

The sizing compounds contemplated for use in the novel sizing process disclosed herein are the higher organic ketene dimers of the following formula:

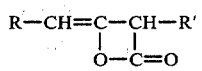

wherein R and R′ are independently chosen from the group consisting of saturated and unsaturated alkyl radicals having at least eight carbon atoms, cycloalkyl radicals having at least six carbon atoms, aryl, aralkyl and alkaryl radicals.

Specific examples of sizing compounds falling within the scope of our invention include: octyl, decyl, dodecyl, tetradecyl, hexadecyl, octadecyl, eicosyl, docosyl, tetracosyl, phenyl, benzyl, $\beta$-napthyl and cyclohexyl ketene dimers, as well as the ketene dimers prepared from montanic acid, napthanic acid, $\Delta^{9,10}$-decylenic acid, $\Delta^{9,10}$-dodecylenic, palmitoleic acid, oleic acid, ricinoleic acid, petroselinic acid, vaccenic acid, linoleic acid, tariric acid, linolenic acid, eleostearic acid, licanic acid, parinaric acid, gadoleic acid, arachidonic acid, cetoleic acid, erucic acid and selacholeic acid as well as ketene dimers prepared from naturally occurring mixtures of fatty acids, such as those mixtures found in coconut oil, babassu oil, palm kernel oil, palm oil, olive oil, peanut oil, rape oil, beef tallow, lard (leaf) and whale blubber. Mixtures of any of the above-named compounds with each other may also be used. The preparation of these compounds is known to those skilled in the art. Typical commercially available products which may be employed include Aquapel 364, Aquapel 421, Aquapel 467 and Hercon 33 all tradenames for products sold by Hercules, Incorporated, Wilmington, Delaware.

The polyoxyalkylene alkyl or polyoxyalkylene alkyl-aryl ethers or corresponding mono- or di-esters useful herein comprise polyoxyethylene or polyoxypropylene alkyl and alkyl-aryl ethers or esters containing five to twenty polyoxyethylene (or polyoxypropylene) units wherein the alkyl radical contains from eight to twenty carbon atoms and the aryl radical is preferably phenyl. The specific ethers or mono- or di-esters used in the present invention are those derived from polyoxyethylene or polyoxypropylene diols in which one or both of the terminal hydroxyl groups are etherified or esterified. The generic formulae of the compounds operable in the invention are:

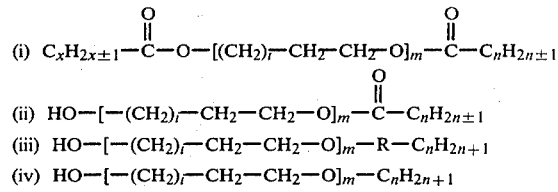

wherein x and n are integers in the range of 8 to 20; R is an aryl radical; m is an integer in the range of 5 to 20; and i is 0 or 1.

The preparation of these materials is also known to those skilled in the art. Typical commercially available products useful in the method of this invention include Renex 690 sold by ICI America, Incorporated, Wilmington, Delaware; Triton X-100, Triton N-101, Triton X-165 and Triton N-57 sold by Rohm and Haas Company, Philadelphia, Pennsylvania; Tergitol NP-27, Tergitol NP-33 and Tergitol TMN sold by Union Carbide Corporation, New York, New York; and Igepal CO-630 sold by GAF Corporation, New York, New York as well as PEG 400 Monooleate supplied by Finetex, Incorporated and PEG 600 Dilaurate sold by Armak Chemical Division of Akzona, Inc.

In accordance with the method of this invention, the size mixture is formed by mixing 80 to 97 parts by weight, preferably 90 to 95 parts, of the aforementioned ketene dimers with 3 to 20 parts, preferably 5 to 10 parts, of the selectd polyoxyalkylene alkyl or alkyl-aryl ethers or esters. The use of the latter component in excess of about 15–20 parts becomes uneconomical in terms of cost since much of the material may be wasted, while amounts in excess of about 20 parts may even be detrimental in terms of the papermaking operation.

It is to be recognized that mixtures of various combinations of ketene dimers and/or polyoxyalkylene alkyl or alkyl-aryl ethers or esters may be used in preparing a particular size mixture, as long as they fall within the scope of this invention.

If pre-emulsification of the size mixture is desired, it may be readily accomplished by adding the sizing components to water in sufficient quantity so as to yield an emulsion containing the ketene dimer in a concentration of from about 0.5 to 20% by weight. Since the ketene dimer can be either liquid or solid, the physical properties of the dimer and therefore the manner of preparation of the size emulsions will vary depending upon the specific ketene dimer employed. Thus, the longer chain, more highly saturated compounds which are solid must be melted before mixing with the polyoxyalkylene alkyl or alkyl-aryl ether or ester and then added to the water which has been previously warmed in order to produce a satisfactory emulsion. The shorter chain, less saturated or unsaturated compounds which are liquid may be easily mixed with the polyoxyalkylene alkyl or alkylaryl ether or ester and added directly to the water to produce the emulsion and therefore are preferred for use in the invention. In either case, the aqueous mixture is thereafter sufficiently emulsified merely by passing it through a mixing valve, aspirator or orifice so that the average particle size of the resultant emulsion will be less than about 3 microns. It is to be noted that in preparing the emulsion, it is also possible to add the components of the size mixture to the water separately, and that the emulsion may be prepared using continuous or batch methods.

In the preferred embodiment wherein the ketene dimer is liquid, emulsification of the mixture readily occurs at ambient temperatures and no advantage is found in elevating the mixture above about 25° C. although higher temperatures could be employed without affecting the sizing properties of the mixture. Thus, the emulsification will occur directly in cold water and heating of the water prior to addition of the sizing mixture is unnecessary.

As to actual use, no further dilution of the emulsion is generally necessary. The thus-prepared emulsion is simply added to the wet end of the paper making machine or to the stock preparation system so as to provide a concentration of the ketene dimer of from about 0.01 to about 2.0% based on dry fiber weight. Within the mentioned range, the precise amount of size which is to be used will depend for the most part upon the type of pulp which is being treated, the specific operating conditions, as well as the particular end use for which the paper product is destined. For example, paper which will require good water resistance or ink holdout will necessitate the use of a higher concentration of size than paper which will be used in applications where these properties are not critical.

In another embodiment of this invention, instead of adding the size emulsion to the stock preparation system, the size emulsion may be sprayed onto the surface of the formed web at any point prior to the drying step. In accordance with this embodiment, the emulsion is used in the concentrations as prepared and is sprayed onto the web so as to provide the required size concentration.

In accordance with a preferred embodiment of the present invention, the ingredients of the size mixture may be premixed without water and added to the papermaking stock system. In this case, it is necessary to use a liquid ketene dimer which will then emulsify in situ in the stock preparation system without the need for prior emulsification in water. As in the case in which the size is emulsified prior to use, the amount of size employed will vary depending on conditions, however, it will generally be within the range of about 0.01 to 2.0% ketene dimer based on dry weight.

An important factor in the effective utilization of the size mixtures herein involves their use in conjunction with a material which is either cationic or is capable of ionizing or dissociating in such a manner as to produce one or more cations or other positively charged moieties. These cationic agents, as they hereinafter will be referred to, have been found useful as a means for aiding the retention of the ketene dimers as well as for bringing the latter into close proximity to the pulp fibers. Among the materials which may be employed as cationic agents in the method of this invention, one may list long chain fatty amines, amine-containing synthetic polymers (primary, secondary, tertiary or quaternary amine), substituted polyacrylamide, animal glue, cationic thermosetting resins and polyamide-epichlorohydrin polymers. Of particular use as cationic agents are various cationic starch derivatives including primary, secondary, tertiary or quaternary amine starch derivatives and other cationic nitrogen substituted starch derivatives, as well as cationic sulfonium and phosphonium starch derivatives. Such derivatives may be prepared from all types of starches including corn, tapioca, potato, waxy maize, wheat and rice. Moreover, they may be in their original granule form or they may be converted to pregelatinized, cold water soluble products.

Any of the above noted cationic retention agents may be added to the stock, i.e. the pulp slurry, either prior to, along with or after the addition of the size mixture or size emulsion.

With respect to the amount of cationic retention agent necessary, under ordinary circumstances, the cationic agent is added to the stock system in an amount of at least about 0.01%, preferably 0.025 to 3.0%, based on dry fiber weight. While amounts in excess of about 3% may be used, the benefits of using increased amounts of retention aid for sizing purposes are usually not economically justified.

Subsequent to the addition of the size emulsion and retention aid, the web is formed and dried on the papermaking machine in the usual manner. While partial sizing is generally achieved immediately off the paper machine, further improvements in the water resistance of the paper prepared with the size mixtures of this invention may be obtained by curing the resulting webs, sheets or molded products. This curing process generally involves heating the paper at temperatures in the range of from 80° to 150° C. for a period of from 1 to 60 minutes. It is to be noted that this post-curing is not essential to the successful operation of the improved sizing method described herein and satisfactory curing will occur with time at ambient temperatures.

The size mixtures of the present invention may, of course, be successfully utilized for the sizing of paper prepared from all types of both cellulosic and combinations of cellulosic with non-cellulosic fibers. The hardwood or softwood cellulosic fibers which may be used include bleached and unbleached sulfate (Kraft), bleached and unbleached sulfite, bleached and unbleached soda, neutral sulfite semi-chemical, groundwood, chemi-groundwood, and any combination of these fibers. These designations refer to wood pulp fibers which have been prepared by means of a variety of processes which are used in the pulp and paper industry. In addition, synthetic cellulosic fibers of the viscose rayon or regenerated cellulose type can also be used, as well as recycled waste papers from various sources.

All types of pigments and fillers may be added in the usual manner to the paper product which is to be sized. Such materials include clay, talc, titanium dioxide, calcium carbonate, calcium sulfate and diatomaceous earths. Stock additives such as defoamers, pitch dispersants, slimicides, etc. as well as other sizing compounds can also be used with the size mixtures described herein.

The use of the size mixtures described herein in accordance with the method of this invention has been found (as will be illustrated by the examples which follow) to yield paper products having improved size properties, for example, resistance to water or acidic ink solutions. In other words, a specified degree of size properties in paper products can be achieved with a smaller amount of size when the size composition is utilized in accordance with the method of this invention rather than by methods known in the prior art.

The following examples will further illustrate the embodiments of the present invention. In these examples, all parts given are by weight unless otherwise specified.

EXAMPLE I

This example illustrates the preparation and use of size mixtures of this invention in the form of aqueous emulsions. These emulsions are compared, in terms of particle size and water resistance of the resulting sized paper, with conventional emulsions wherein alkyl ketene dimer is emulsified with cationic starch. A further comparison is made with a rosin/alum sizing method as commonly employed in the paper industry. The much greater ease of emulsification of the size mixtures of this invention is demonstrated by the procedure used in preparing the sizing emulsions prior to their addition to the paper stock system.

The size mixtures were prepared by combining (A) 10 parts of a polyoxyalkylene alkyl-aryl ether wherein the alkyl group contained 9 carbon atoms, the aryl radical was phenyl and the polyoxyalkylene moiety was formed with 10 moles of ethylene oxide and (B) 90 parts of alkyl ketene dimer. Two size mixtures were prepared in these proportions: Size Mixture 1 was prepared with a solid alkyl ketene dimer wherein the saturated alkyl radical contained 16 carbon atoms; Size Mixture 2 was prepared with a liquid alkyl ketene dimer wherein the unsaturated alkyl radical contained 10 carbon atoms. In the case of Size Mixture 1, the alkyl ketene dimer was first melted prior to mixing with the polyoxyalkylene alkyl-aryl ether component.

Emulsions were then formed by agitating 2 parts of each mixture with 98 parts of water using a propeller-type mixer at moderate speed for 10 seconds. The water was first preheated to about 160° F. in preparing the emulsion with Size Mixture 1 (Emulsion #1), while cold water was used to prepare an emulsion with Size Mixture 2 (Emulsion #2).

For comparison, conventional aqueous emulsions of each ketene dimer were prepared by first cooking 4 parts of the beta-diethyl aminoethyl chloride hydrochloride ether of corn starch, whose preparation is described in Example I of U.S. Pat. No. 2,813,093, and 0.3 part sodium lignosulfonate in 96 parts of water by heating with direct steam to about 195° F. and holding at that temperature for 15 minutes. The cook was then cooled to about 165° F. and 8 parts of alkyl ketene dimer added with vigorous agitation. The temperature was then reduced to 140°–160° F. and the mixture homogenized in a Waring blender for 5 minutes, then immediately cooled by adding dilution water to yield an emulsion of 1% total solids, Emulsion #3 was prepared in the conventional manner described above using the alkyl ketene dimer employed in Size Mixture 1, while Emulsion #4 was prepared in the same manner using the alkyl ketene dimer employed in Size Mixture 2.

Calculated amounts of the emulsions prepared as described above were added to aqueous slurries of bleached sulfate pulp having a Williams freeness of 400, a consistency of 0.5% and a pH of about 7.6, so as to yield 0.1% and 0.2% ketene dimer on dry fiber weight. The cationic starch used in making Emulsions #3 and #4 was then added to each pulp slurry subsequent to the addition of each emulsion in a concentration of 0.4% on dry fiber weight to retain these materials in the sheet. Sheets were formed and dried in accordance with TAPPI standards, then cured 1 hour at 105° C. and conditioned overnight at 72° F. and 50% R.H. before testing. The basis weight of these sheets was 55 lbs./ream (24"×36"—500 sheets).

In comparing the water resistance of these sheets, use was made of a dye test employing crystals of potassium permanganate and an acid ink penetration test. In the dye test several crystals of potassium permanganate are placed on the upper surface of a swatch of test paper which is then set afloat in distilled water at room temperature. As the water is absorbed into the paper the crystals are moistened and impart a characteristic deep violet color to the paper. The time measured in seconds required for an end-point where three colored spots first appear on the paper surface is noted and is in direct relation to the water resistance since a more water resistant paper will retard the moistening of the permanganate drystals which had been placed upon its upper surface.

The acid ink penetration test is a comparison test wherein a swatch of test paper is floated in a dish of acid ink (pH 1.5) at 100° F. and the time measured in seconds required for the ink to penetrate through the paper to reach an end-point where about 50% of the paper is colored is noted.

The following table presents data on the various paper sheets which were compared in the described testing procedures.

TABLE I

| Sheet NO. | Sizing Emulsion | Average Particle Size of Emulsion (Microns) | % ketene dimer by Wt. of Dry Pulp | Acid Ink Penetration (Time in Seconds) | $KMnO_4$ (Time in Seconds) |
|---|---|---|---|---|---|
| 1 | Emulsion #1 | 1–3 | 0.1 | 600+ | 62 |
| 2 | Emulsion #1 | 1–3 | 0.2 | 600+ | 75 |
| 3 | Emulsion #2 | Under 1 | 0.1 | 320 | 53 |
| 4 | Emulsion #2 | Under 1 | 0.2 | 600+ | 70 |
| 5 | *Emulsion #3 | 1–3 | 0.1 | 600+ | 52 |
| 6 | *Emulsion #3 | 1–3 | 0.2 | 600+ | 65 |
| 7 | *Emulsion #4 | 1–2 | 0.1 | 200 | 49 |
| 8 | *Emulsion #4 | 1–2 | 0.2 | 600+ | 60 |
| 9 | *Rosin/Alum | — | 1.0 | 235 | 61 |
| 10 | *Blank | — | None | 0 | 0 |

*Control sheets for comparative purposes.

The above data clearly shows the greater ease of preparation and superiority of the size mixtures of this invention both in terms of the small particle size of emulsions formed with these compositions and in terms of water resistance imparted to the sized paper over a range in level of addition typically employed in the industry.

EXAMPLE II

This example illustrates the use of size mixtures of this invention wherein different polyoxyalkylene alkyl or alkyl-aryl ether or the corresponding mono- or di-ester compounds are utilized in the mixture with the ketene dimers described herein.

In this example, the ketene dimer was the same material described to prepare Size Mixture 2 in Example I, while the polyoxyalkylene alkyl and alkyl-aryl ether compounds used in the size mixtures was varied. Size mixtures used in this example were prepared as follows: Size Mixture #1—5 parts of the polyoxyalkylene alkyl-aryl ether described in Example I were mixed with 95 parts of the ketene dimer; Size Mixture #2—15 parts of the polyoxyalkylene alkyl-aryl ether described in Example I were mixed with 85 parts of the ketene dimer; Size Mixture #3—10 parts of a polyoxyalkylene alkyl-aryl ether wherein the alkyl group contains 9 carbon atoms, the aryl radical is phenyl and the polyoxyalkylene moiety was formed with 5 moles of ethylene oxide were mixed with 90 parts of the ketene dimer; Size Mixture #4—10 parts of a polyoxyalkylene alkyl ether wherein the alkyl group contains 12 carbon atoms and the polyoxyalkylene moiety was formed with 6 moles of ethylene oxide were mixed with 90 parts of the ketene dimer; Size Mixture #5—10 parts of a polyoxyalkylene alkyl-aryl ether wherein the alkyl group contains 9 carbon atoms, the aryl radical is phenyl and polyoxyalkylene moiety was formed with 15 moles of ethylene oxide were mixed with 90 parts of the ketene dimer. Emulsions were then formed with each of these mixtures by passing the mixture through a simple aspirator, together with a constant-stream of water, to yield 2% concentration of size mixture in one pass. The emulsions were thus formed almost instantaneously. The emulsions were then added to a 0.5% consistency pulp slurry containing bleached sulfate pulp beaten to a Williams freeness of 400 and at a pH of approximately 7.6 to yield 0.2% ketene dimer on weight of dry fiber. The cationic starch described in Example I was then added to the pulp slurry to yield 0.4% cationic starch on weight of dry pulp. Handsheets thereafter were formed, conditioned and tested by the potassium permanganate dye test described in Example I. The basis weight of these sheets was 55 lbs./ream (24"×36"-500 sheets). Following were the results obtained:

TABLE 2

| Size Mixture No. | Average Particle Size of Emulsion (Microns) | $KMnO_4$ (Time in Seconds) |
|---|---|---|
| 1 | 1-2 | 76 |
| 2 | Under 1 | 78 |
| 3 | 1-2 | 70 |
| 4 | 1-2 | 73 |
| 5 | 1-4 | 63 |

In the same manner, size mixtures can be prepared using the ketene dimers together with polyoxyethylene Monooleate ester wherein the molecular weight of the polyoxyethylene moiety is 400 as well as with polyoxyethylene dilaurate ester wherein the molecular weight of the polyoxyethylene moiety is 600 and wherein these size mixtures are used in the paper sizing process, similar superior results will be obtained.

This example clearly shows that various polyoxyalkylene alkyl and alkyl-aryl ethers and esters, within the scope of this invention, can be used interchangeably in size mixtures with the ketene dimers described herein to yield excellent sizing performance.

EXAMPLE III

This example illustrates a preferred embodiment of our invention wherein the novel size mixtures are directly added to a papermaking stock system in unemulsified form.

A size mixture consisting of 90 parts of the ketene dimer utilized to prepare Size Mixture 2 in Example I and 10 parts of the polyoxyalkylene alkyl-aryl ether described in Example I was added directly to a slurry of bleached sulfate pulp at 1.5% consistency in a propeller-type laboratory mixer while agitating at moderate speed. After continuing agitation for a few minutes, the pulp was then diluted to 0.5% consistency, and 0.4% on dry fiber weight of the cationic starch described in Example I was added separately to the slurry to act as a retention aid during sheet formation. For comparative purposes, 0.2% of the ketene dimer was added in the same manner as described above, but was not first mixed with the polyoxyalkylene alkyl-aryl ether before addition to the pulp slurry. Cationic starch was also added to a concentration of 0.4% on dry fiber weight to act as a retention aid for the ketene dimer. Sheets were then formed, conditioned and tested in the potassium permanganate dye test as described in Example I. The basis weight of these sheets was 55 lbs./ream (24"×36"—500 Sheets). Following are the results obtained:

TABLE 3

| Sheet No. | Size Mixture | % Ketene Dimer by Wt. Dry Pulp | $KMnO_4$ (Time in Seconds) |
|---|---|---|---|
| 1 | Ketene Dimer/Polyoxyalkylene alkylaryl ether | 0.2 | 67 |
| 2 | Ketene Dimer (Control) | 0.2 | 14* |
| 3 | Blank | None | 0 |

*Many spots of rapid penetration were evident when sheets prepared with ketene dimer alone were dipped in dilute ink to ascertain uniformity of liquid absorption.

The rapid self-emulsifying properties of these size mixtures are demonstrated by the excellent sizing value achieved when they are added to the stock without prior emulsification in water. Consequently, the considerable ease and versatility in the use of the size mixtures of this invention can be readily seen.

In the same manner, size mixtures prepared from the ketene dimers together with polyoxyethylene Monooleate ester wherein the molecular weight of the polyoxyethylene moiety is 400 or from the ketene dimer with a polyoxyethylene dilaurate ester having a polyoxyethylene molecular weight of 600 can be added directly to the paper making stock system in unemulsified form with correspondingly superior results.

EXAMPLE IV

This example illustrates the use of various types of cationic agents in conjunction with the size mixtures of this invention. In this example, the size mixture used was the same as Size Mixture 2 described in Example I and was emulsified, prior to addition to the plup slurry, in the same manner as described in Example II. The emulsion was added to portions of a 0.5% consistency pulp slurry containing bleached sulfate pulp at a pH of 7.6 and beaten to a Williams freeness of 400. Subsequent to the addition of size emulsion, different cationic agents were added to separate slurries in order to retain the size emulsion in the web during sheet formation. An amount of size emulsion was added so as to yield 0.2% ketene dimer on dry fiber weight in each case, while the amount of cationic agent was varied. Sheets of 55 lbs./ream (24"×36"—500 sheets) basis weight were then formed from each slurry, conditioned and tested in the manner described in Example I. Following are the results obtained:

TABLE 4

| Sheet No. | Cationic Agent | % cationic agent by wt. of Dry Fiber | Acid Ink Penetration (Time in Seconds) | $KMnO_4$ (Time in Seconds) |
|---|---|---|---|---|
| #1 | Cationic Corn Starch | 0.4 | 600+ | 65 |
| 2 | Polyamide-Epichlorohydrin Resin | 0.2 | 600+ | 63 |
| 3 | Polyethylene Imine Resin | 0.2 | 600+ | 69 |
| 4 | Polyaminoethyl Acrylate Resin | 0.2 | 600+ | 72 |
| 5 | Polyacrylamide-Amine Resin | 0.2 | 600+ | 66 |
| 6 | Cationic Potato Starch | 0.4 | 550 | 55 |
| 7 | None (Control) | — | 0 | 0 |

The above data clearly shows that various cationic agents can be effectively employed to retain the size mixtures of this invention in the web during the sheet forming stage.

EXAMPLE V

This example illustrates the excellent resistance to highly acidic and alkaline solutions which is displayed by the paper which has been prepared with our novel size mixtures. An aqueous emulsion prepared with the same size mixture and used in the same manner as described in Example IV was added to a bleached sulfate pulp slurry having a Williams freeness of 400, a consistency of 0.5% and a pH of 7.6. The cationic starch of Example I was then added to the stock as a retention aid for the ketene dimer. Sheets containing 0.4% ketene dimer and 0.8% cationic starch were formed and conditioned as described in Example I. The basis weight of these sheets was 55 lbs./ream (24"×36"—500 sheets). The sheets were tested by means of a modified potassium permanganate test wherein solutions of 20% lactic acid in one case and 10% sodium hydroxide in another case were used as the test fluid, along with distilled water as a control. For a further comparison, sheets were formed and tested in the same manner wherein 1% rosin and 4% alum on dry fiber weight was added to the stock for sizing in place of our size mixture. Following are the results obtained:

TABLE 5

| Sheet NO. | Additive | $KMnO_4$ Penetration (Time in Seconds) Distilled Water | Lactic Acid | Sodium Hydroxide |
|---|---|---|---|---|
| 1 | Size Mixture | 68 | 53 | 35 |
| 2 | Rosin/Alum | 61 | 26 | 8 |

This example clearly shows the excellent resistance imparted by these size mixtures to penetration by both acidic and alkaline fluids.

In summary, the invention is seen to provide the practitioner with a novel size mixture useful in the manufacture of sized paper products. The size mixture is easily emulsified and the emulsion or size mixture per se may be utilized under a wide variety of papermaking conditions to provide sized paper products characterized by their reduced water and ink absorption as well as their increased resistance to aqueous acid and alkaline solutions at low levels of addition. Variations may be made in proportions, procedures and materials without departing from the scope of this invention.

We claim:

1. In a method for the internal sizing of paper products with a sizing emulsion consisting essentially of:

(a) from 80 to 97 parts by weight of a higher organic ketene dimer of the formula:

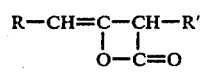

wherein R and R' are independently chosen from the group consisting of saturated and unsaturated alkyl radicals having at least eight carbon atoms, cycloalkyl radicals having at least six carbon atoms, aryl, aralkyl and alkaryl radicals;

(b) from 3 to 20 parts of a polyoxyalkylene alkyl or polyoxyalkylkene alkyl-aryl ether or the corresponding mono- or di-ester selected from the group consisting of:

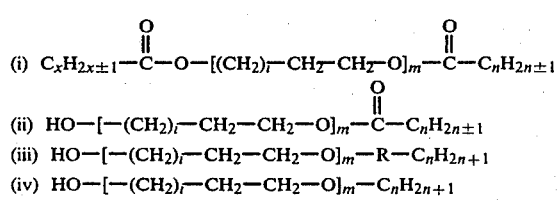

wherein x and n are integers in the range of 8 to 20; R is an aryl radical; m is an integer in the range of 5 to 20; and i is 0 or 1; and (c) water;

the improvement which comprises adding a mixture of components (a) and (b) to a paper stock system, in an amount sufficient to provide a concentration of ketene dimer of from 0.01 to 2.0%, based on dry fiber weight, whereby the sizing emulsion is formed in situ within the paper stock system at not more than about 25° C.

2. In a method for the internal sizing of paper products with a sizing emulsion consisting essentially of:

(a) from 80 to 97 parts by weight of a higher organic ketene dimer of the formula:

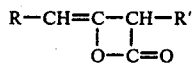

wherein R and R′ are independently chosen from the group consisting of saturated and unsaturated alkyl radicals having at least eight carbon atoms, cycloalkyl radicals having at least six carbon atoms, aryl, aralkyl and alkaryl radicals;

(b) from 3 to 20 parts of a polyoxyalkylene alkyl or polyoxyalkylene alkyl-aryl ether or the corresponding mono- or di-ester selected from the group consisting of:

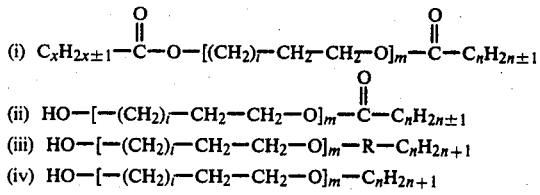

wherein x and n are integers in the range of 8 to 20; R is an aryl radical; m is an integer in the range of 5 to 20; and i is 0 or 1; and (c) water;

the improvement which comprises forming the sizing emulsion at no more than about 25° C. by passing a mixture of components (a) and (b) and (c) through a mixing means of the aspirator, orifice and mixing valve type, and thereafter adding the resultant sizing emulsion to a paper stock system in an amount sufficient to provide a concentration of ketene dimer of from 0.01 to 2.0%, based on dry fiber weight.

* * * * *